US009042077B2

(12) United States Patent
Jones et al.

(10) Patent No.: US 9,042,077 B2
(45) Date of Patent: May 26, 2015

(54) STUN GUN AND METHOD OF USE

(71) Applicants: Douglas B Jones, Sparks, NV (US); Paul B. Reddis, Sparks, NV (US)

(72) Inventors: Douglas B Jones, Sparks, NV (US); Paul B. Reddis, Sparks, NV (US)

(73) Assignee: HANDS DOWN TECHNOLOGIES, LLC., Reno, NV (US)

( * ) Notice: Subject to any disclaimer, the term of this patent is extended or adjusted under 35 U.S.C. 154(b) by 0 days.

(21) Appl. No.: 13/945,881

(22) Filed: Jul. 18, 2013

(65) Prior Publication Data

US 2014/0022688 A1 Jan. 23, 2014

Related U.S. Application Data

(60) Provisional application No. 61/673,166, filed on Jul. 18, 2012.

(51) Int. Cl.

| | |
|---|---|
| ***F41B 15/04*** | (2006.01) |
| ***H01T 23/00*** | (2006.01) |
| ***F41H 13/00*** | (2006.01) |

(52) U.S. Cl.

CPC ..... *F41H 13/0018* (2013.01)

(58) Field of Classification Search

USPC ..... 361/232

See application file for complete search history.

(56) References Cited

U.S. PATENT DOCUMENTS

| | | | | |
|---|---|---|---|---|
| 4,488,726 | A * | 12/1984 | Murray | 473/202 |
| 4,510,939 | A * | 4/1985 | Brenman et al. | 600/384 |
| 5,289,164 | A | 2/1994 | Novak | |
| 5,379,179 | A | 1/1995 | Graves | |
| 6,646,855 | B2 * | 11/2003 | Buening et al. | 361/232 |
| 7,012,797 | B1 | 3/2006 | Delida | |
| 7,477,504 | B1 * | 1/2009 | Delida | 361/230 |
| 8,154,844 | B2 * | 4/2012 | Brown | 361/232 |
| 8,477,986 | B1 * | 7/2013 | Kiser | 381/388 |
| 2004/0154071 | A1 * | 8/2004 | Frahm | 2/160 |
| 2004/0264099 | A1 * | 12/2004 | Sikes et al. | 361/232 |
| 2012/0243141 | A1 * | 9/2012 | Schweitzer | 361/232 |
| 2014/0188194 | A1 * | 7/2014 | Schepis et al. | 607/62 |

* cited by examiner

*Primary Examiner* — Dharti Patel

(74) *Attorney, Agent, or Firm* — Long & Chybik; John D. Long, Esq.

(57) ABSTRACT

The invention could be a stun glove and a method of operating the same, the stun gun could comprise a glove portion made from a laminate of an inside material and an outside material, the laminate forms a cavity adapted for covering at least a portion of a hand within at least a thumb sleeve; an electronic circuitry when activated by a trigger mechanism generates a pulsed electrical charge to a plurality of electrodes, the electronic circuitry being embedded within the laminate in a manner to expose each said electrode to a glove portion exterior; and the trigger mechanism located within the thumb sleeve so as to be proximate to a leading edge of a tip of the thumb sleeve.

15 Claims, 3 Drawing Sheets

STUN GUN AND METHOD OF USE

CROSS-REFERENCES TO RELATED APPLICATIONS

Not Applicable.

STATEMENT REGARDING FEDERALLY SPONSORED RESEARCH OR DEVELOPMENT

Not Applicable

REFERENCE TO A "MICROFICHE APPENDIX"

Not Applicable

CLAIM TO MICRO ENTITY STATUS

Both inventors claim Micro Entity Status and both have submitted individual Micro Entity Status Declarations (GROSS ECONOMIC BASIS) Declarations PTO/SB/15A with the present Application in support thereof.

FIELD OF THE INVENTION

The present invention generally relates to self-defense electrical discharge devices that substantially and temporarily incapacitate humans or other animals. More particularity to those self-defense electrical discharge devices worn over a hand.

BACKGROUND

Stun guns may be considered self-defense electrical discharge devices that generally directly deliver a high voltage (e.g., several million volts), low amperage, pulsed electrical charges to a third party (e.g., an assailant) substantially allowing the operator of the stun gun to control or subdue the assailant or even flee from the encounter with the assailant. The delivered charge may cause the assailant temporary and reversible impairment to its voluntary muscle motor function, mental processing capability (possibly causing unconsciousness) and alike depending on the electrical discharge's frequency, duration, voltage and amperage. This electrical discharge delivery may also be considered a localized phenomenon in that when the electrical discharge occurs with the operator touching the assailant, the electrical discharge does not readily bleed back from the assailant's body to harm the operator who may be touching the assailant in the process.

The stun gun may be a handheld unit containing a portable power source (e.g., rechargeable battery[ies]) connected to an electrical charge generation circuitry. This circuitry may be further controlled by a trigger mechanism to discharge the electrical discharge through a plurality of electrodes (e.g., metal contacts) both electrodes being exposed to an exterior or outside of the stun gun. An operator may hold the stun gun in a manner that allows activation of the trigger mechanism and the projection of the respective electrodes into contact with the assailant for the discharge.

One possible electrical charge circuit for such electrical discharge self-defense devices could comprise of a portable DC power source (e.g., one or more rechargeable batteries) generally connected by the trigger mechanism to a power oscillator, which may convert the DC power from the power supply to AC power or a pulsed DC power. This AC power/pulsed DC power may then be sent onto a first transformer (e.g., generally transformers cannot work using straight DC power as supplied by batteries), which could step up the electrical charge to a higher voltage (e.g., up to 400 to 1200 volts DC.) The first transformer then may send the electrical charge onto a diode/capacitor circuit, which generally converts the electrical charge back to DC current and may further increase the voltage of the electrical charge before storing the electrical charge in a capacitor(s) of the diode/capacitor circuit. When the electrical charge leaves that diode/capacitor circuit, the electrical charge goes through a pulse circuit, which may rapidly turn the electrical charge on and off to create a pulsed DC electrical charge. The frequency of this pulse circuit may be matched to the electrical frequency of the body's nervous system (e.g. the assailant's body) that is used to operate and control voluntary muscle motor function. In this manner, the electrical charge may match and mimic the nervous system's electrical pulses so that electrical discharge may cause the assailant's muscles to rapidly contact and expand to a point of extreme/total exhaustion/fatigue. The pulsed DC electrical charge may leave this pulse circuit to go onto a second (e.g., optional) transformer, which may pump up the pulsed DC electrical charge even further before the pulsed DC electrical charge goes to the electrodes (e.g., electrical discharge contact points) to be discharged outside the device. Generally, the distance between the electrical discharge contact points or electrodes determines the final voltage of the created electric discharge. The voltage is generally a means of forcing the electrical charge through clothing and skin into the body of the assailant while the amperage and pulse frequency helps deliver the electrical charge to and then into the nerves/motor control muscles.

While many such self-defense stun devices can be seen as being a stand-alone, hand-held apparatuses, other versions of these devices may be incorporated into or with a second different device, such as an article of clothing like a glove (e.g. a stun glove.) This stun glove readily allows the operator to wear the combined devices with its defensive capability immediately readily for use (vs. having to retrieve a stun gun from a pocket, purse, bag or the like-when seconds count.) It could also generally conceal the stun gun's defensive nature (e.g. an assailant could assume by its ordinary appearance that the stun glove could lack electronic self-defense capabilities) thus giving an operator a possible tactical element of surprise in an unexpected aggressive situations requiring self-defense. Further, having the device being worn by the operator instead of being held by the operator may ameliorate attempts by an assailant to remove the device from the operator or to remove the control of the device from the operator. Such a stun glove can be used by private and governmental security personnel: individual consumers and the like.

Current stun gloves may, for various reasons, may have the triggering mechanisms and contacts points located on the stun glove in less than convenient-to-use position. One such stun glove may have its electrodes located on the backhand side of the glove located over the metacarpals of the hand. Its trigger mechanism may also be located in the same area just to the right of the electrodes thus creating safety concerns with activation and the element of surprise. The electrodes located on the back of the hand could make it more difficult contact and activate them with an assailant is attacking the operator.

What could be needed is a stun glove with a body of non-conductive material wherein each of the electrodes is located on an underside/palm side of a respective finger sleeve of the glove, proximate to the finger tip of the sleeve, to make it easier to contact the assailant by either extended fingers or by grasping the assailant with the stun glove. This stun glove could substantially require the operator to press a leading edge portion of the thumb tip into the assailant to activate the trigger mechanism to cause the stun glove to emit its electrical discharge (and generally reducing the likelihood of unwanted accidental discharge into the operator by herself.)

SUMMARY OF ONE EMBODIMENT OF THE INVENTION

Advantages of One or More Embodiments of the Present Invention

The various embodiments of the present invention may, but do not necessarily, achieve one or more of the following advantages:

to provide a stun glove that has its electrodes proximate to the tips of its finger sleeves of the glove;

the ability to allow the stun glove operator to grasp its assailant with the glove portion to discharge the device;

to provide a stun glove with a thumb-operated trigger mechanism that reduces the likelihood of accidental discharge while allowing effective discharge during assailant attacks;

the ability to substantially operate a stun glove with the same hand wearing the glove to avoid unnecessary delays in operating the stun glove;

to provide a stun glove whose electrode contacts are positioned to help prevent the operator from accidentally shocking themselves with the same hand as that is wearing the glove;

the ability to operate a stun glove whose electrical circuitry components and wiring connecting the electrical circuitry components together are embedded within the glove structure to generally prevent accidental disconnection of the stun gloves electrical components;

to provide a stun glove that utilizes an easily rechargeable power supply;

the ability to activate a stun glove worn on one hand without requiring the operator to use its other hand to activate the stung glove's trigger mechanism;

to provide an electrical discharge based self-defense device that generally resists the attempts by an assailant take over control of the device from the operator; and to provide an electrical discharge self-defense device that generally resists the attempts by an assailant to remove the device from the operator.

These and other advantages may be realized by reference to the remaining portions of the specification, claims, and abstract.

BRIEF DESCRIPTION OF ONE EMBODIMENT OF THE PRESENT INVENTION

One possible embodiment of invention could be a stun glove comprising a glove portion made from a laminate of an inside material and an outside material, the laminate forms a cavity adapted for covering at least a portion of a hand within at least a thumb sleeve; an electronic circuitry when activated by a trigger mechanism generates a pulsed electrical charge to a plurality of electrodes, the electronic circuitry being embedded within the laminate in a manner to expose each said electrode to a glove portion exterior; and the trigger mechanism located within the thumb sleeve so as to be proximate to a leading edge of a tip of the thumb sleeve.

Another embodiment of the invention could be a method for operating a stun glove comprising of the steps of providing a stun glove having a glove portion that reversibly receives and encapsulates at least a portion of a hand and further mounts electronic circuitry for generating a pulsed electrical charge that is discharged through electrodes in finger sleeves formed by the glove portion when a trigger mechanism located in a leading edge of a tip of a thumb sleeve as formed by the glove portion is activated; energizing the electronic circuitry to generate a pulsed electrical charge; pressing the leading edge portion of the thumb sleeve against a surface to activate the trigger mechanism; and discharging the pulsed electrical charge through the electrodes.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
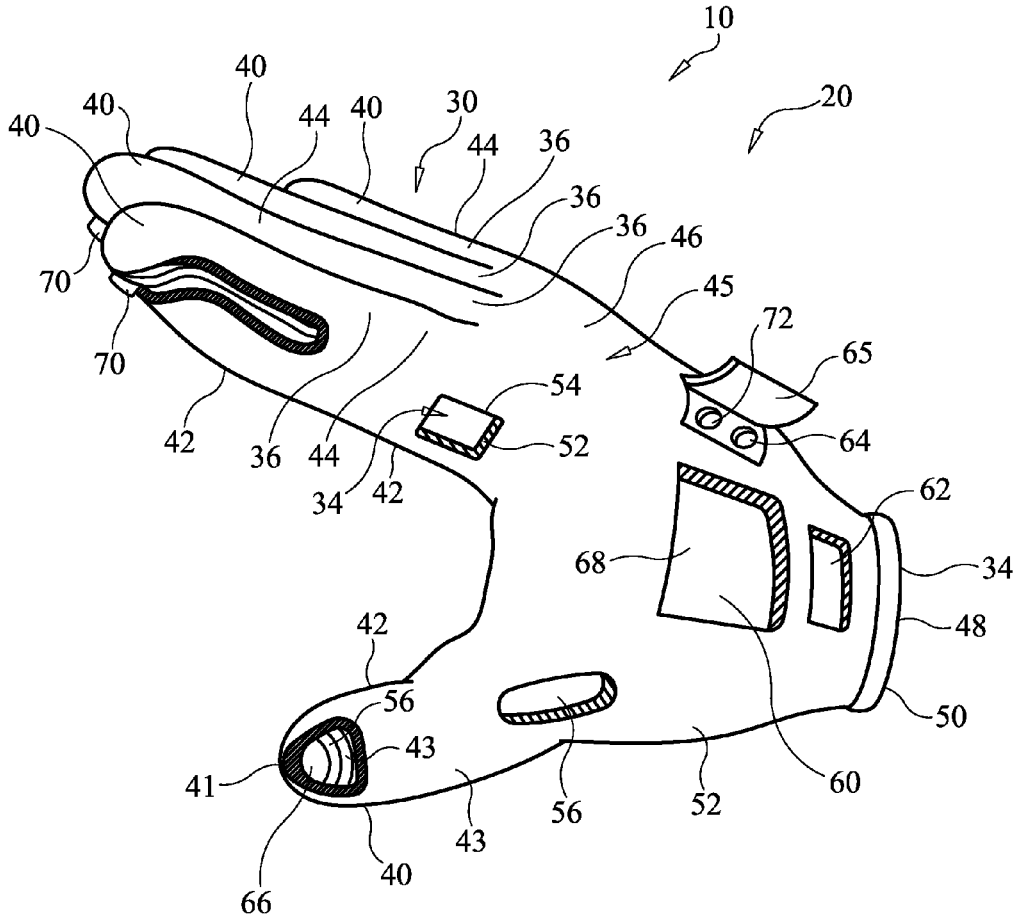
FIG. 1 is a substantially a perspective, cutaway view of the palm or underside portion of one embodiment of the invention.
Figure 2:
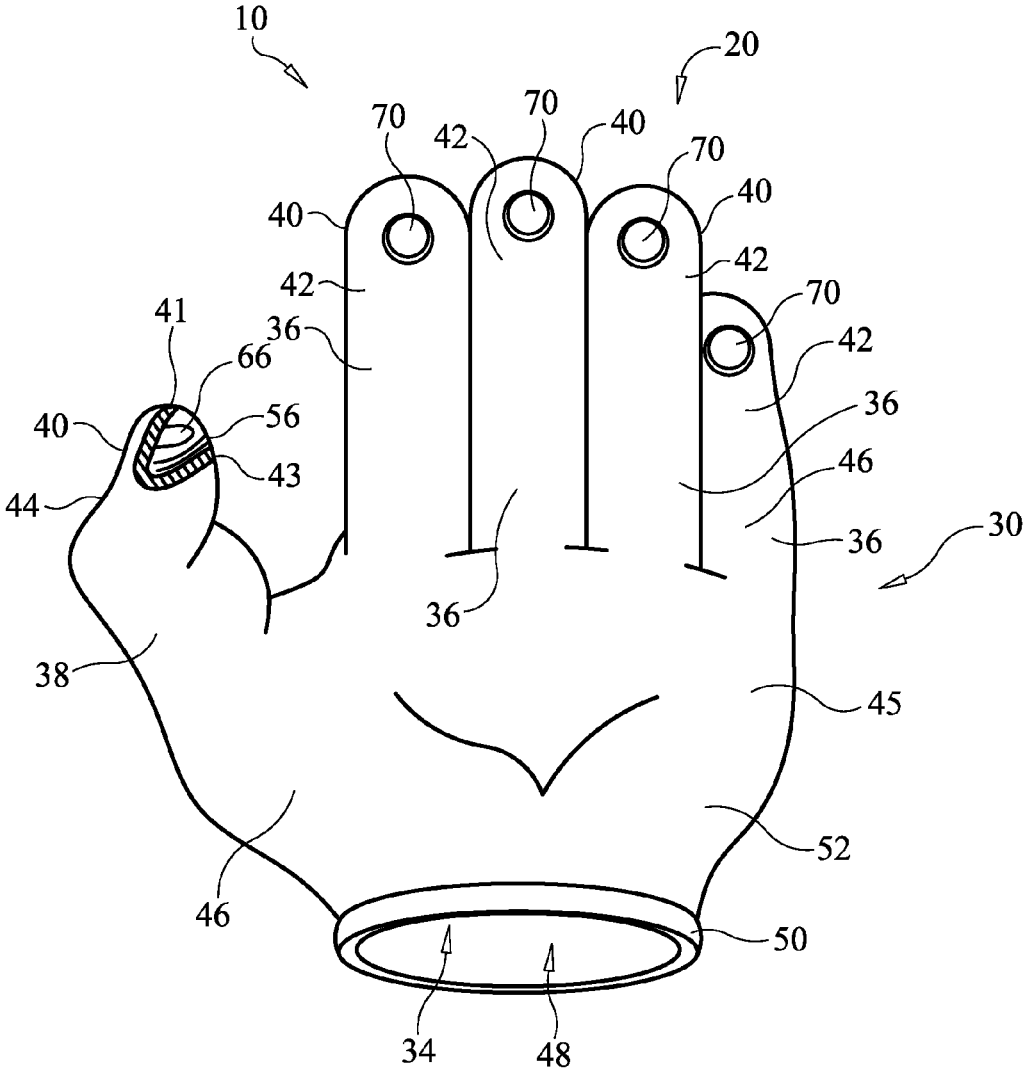
FIG. 2 is substantially a perspective, cutaway view of the stun glove from the back side portion of one embodiment of the invention.

The present invention 10 could comprise of a stun glove 20 and a method or process 100 for its use. As substantially shown in FIGS. 1 and 2, one embodiment of the present stun glove 20 could comprise of glove portion 30 for reversibly receiving and sheathing at least a portion of an operator's hand (e.g., at least two fingers and a thumb of the operator—not shown) and the components of the electrical charge electronic circuit 60 used to generate and transmit the stun glove's electrical charge. The glove portion 30 could be made of a laminate 32 of flexible and electrically insulated fabrics and the like that generally allows the hand and wrist to be removably received with a cavity 34 created by the glove portion 30

(e.g., generally be covered by the stun 30 glove.) The cavity 34 at least being further defined by finger and thumb sleeves (36, 38), palm/back covering enclosure 46 and wrist covering 50. Each sleeve 36, 38 having a tip 40 substantially connected to an underside 42 and top side 44. The finger and thumb sleeves (36, 38) continuously connected to the palm/back hand enclosure 46. An opening 48 generally leading into the cavity 34 allows the stun glove 20 to reversibly receive an operator's hand. The opening 48 could be further defined by the wrist covering 50 continuously connected to the palm/back hand enclosure 46. The construction of the stun glove 20 could allow the invention 10 to be securely affixed to the operator in a manner that could make it difficult for an assailant (substantially shown in FIG. 4) to remove the invention from the operator (substantially shown in FIG. 4) or takeover control of the invention from the operator.

The laminate 32 could comprise of an exterior fabric 52 made from material that is ascetically pleasing to the eye, yet strong and durable enough to resist tearing or cutting and an interior fabric 54 made from a suitable soft material that could absorb moisture and allow the invention 10 to be comfortably worn for long periods of time. In at least in one embodiment, an insulating material 56 (such as PVC or the like) could sandwiched between the two fabrics 34, 36 at various places in the laminate 32 to provide further electrical shock protection for the operator's fingers, hand and wrist (not shown) within the glove portion 30. An insulating polymer or epoxy cement (not shown) could also be applied to the outside of the components of the electronic circuit 60 to further insulate it from disruptions caused by the glove's electric discharge. In at least one embodiment, the insulation 32 located behind the electrodes could further comprise of a plastic layer and nitrile layer for additional insulation and comfort qualities.

The electronic circuitry 60 providing the electrical discharge could comprise of a portable power supply (e.g., rechargeable battery[s]) 62, energizing switch 64, trigger mechanism 66, circuitry board 68 electrodes 70 and suitable wiring for connecting these components. The circuitry board 68 could have solid state components and the like as selected by one skilled in the art that provide transforming, charging, storing functions for the overall electrical charge circuit, as well as a pulsation capability that take the original DC electrical charge of the power source storage and change it into a pulsed, high-voltage, low-ampere DC current discharge. The electrical circuitry board 68 could be one unit or could be disbursed into several separate, yet connected, sub-circuit boards. The electrical circuit board(s) 68 could be located within the laminate 32 proximate to the back side of the palm/hack side covering 46/wrist covering 50.

The energizing switch 64, appropriately connected into electronic circuitry of the electronic circuit 60, could located within the laminate 32 by the back side of the palm/back side covering 46/wrist covering 50. The energizing switch 64 in at least one embodiment could be a single pole/single throw slide switch (e.g., biased open) that could electrically connect the power source 62 to trigger mechanism 66, the trigger mechanism 66 appropriately controlling when the current (electrical charge) goes onto the remaining circuitry (e.g., the oscillating circuit of the circuit board—not shown). The energizing switch 64 could be covered by a flap 65 or like to protect it from being placed into the off position by a non-operator personnel (e.g., an assailant.) Proximate to the energizing switch 64 could be a charger receptacle (not shown) connected to the portable power source 62 to reversibly attach a recharging unit to the power source (e.g., rechargeable batteries) 62.

The electrodes 70 could be affixed to the glove portion 30 wherein each of the electrodes 70 could be positioned proximate the forward portion of a respective finger sleeve 36 such as the tip 40 on the sleeve's underside 42 so that the first digit of the respective finger (not shown) placed with the finger sleeve 36 could move the electrode 70 into contact with an assailant by grasping the assailant. In keeping with the invention 10, the electrodes 70 may be repositioned to different portions of the palm side of the glove portion 30. The electrodes 70, while connected by wire to the remaining electronic circuitry, could be anchored between the laminate 32 but could penetrate the exterior fabric 52 to reach the outside/exterior 45 of the stun glove 20 and expose the electrodes 70 to the outside environment.

In at least one embodiment, an LED power indicator 72 could also be a part of the electronic circuit 60 and could be located in the wrist covering 50 next to the energizing switch 64. The LED power indicator 72 (or other suitable illumination source) could be reversibly covered by the same flap 65 that covers the energizing switch 64 to prevent third parties (e.g., assailants) from identifying the invention 10 as a stun glove 20. When the energizing switch 64 is in the "on" position, the LED light indicator 72 could be lit indicating that the electronic circuitry 60 is energized and the stun glove 20 is armed.

The trigger mechanism 66 could be within the laminate 32 by the leading edge 41 of the tip 40 of the thumb sleeve 38 so that trigger mechanism 66 can be operated by the first digit of the operator's thumb (not shown) pressing against that portion of the glove portion 30 against firm object. When that portion of the thumb sleeve 38 makes contact with assailant (shown in FIG. 4) and is pushed down by the operator (shown in FIG. 4) against the assailant, the operator's action will close the switch of the trigger mechanism 66 and the energized electronic circuit 60 to create its electrical discharge.

Additionally, a strip of plastic 43 could be located within the laminate 32 to generally lie behind the trigger mechanism 60 and in between the operator's thumb and the trigger mechanism 66 when the operator's hand is placed within the stun glove 20. The extra rigidity imparted to the laminate 32 at this location by the plastic strip 43 could help ensure that when the leading edge 41 of the thumb tip 40 is pressed into an assailant (or other firm surface—not shown) by the operator that the trigger mechanism 66 will be appropriately activated.

The positioning and construction of the trigger mechanism 66 could prevent unwanted/accidental discharge of the invention 10 such as when the operator touches herself with the stun glove 20 (e.g., wiping one's brow.) The positioning and construction of the trigger mechanism 66 substantially requires the operator to generally "dig in" the leading edge 41 of the tip of the thumb sleeve 38 into a third person body (rather than merely laying the thumb tip alongside the surface of the body as would be required if the trigger mechanism 66 was placed away from the leading edge 41) with a modicum of force to activate the trigger mechanism 66. The thickness of laminate, any welts sealing the glove at that portion, the resistance posed by the trigger mechanism can be managed to control the amount of force needed to be exerted by the operator's thumb upon the trigger mechanism 66 (and onto assailant's body) to allow proper electrical discharge yet substantially prevent unwanted accidental discharge.

Figure 3:
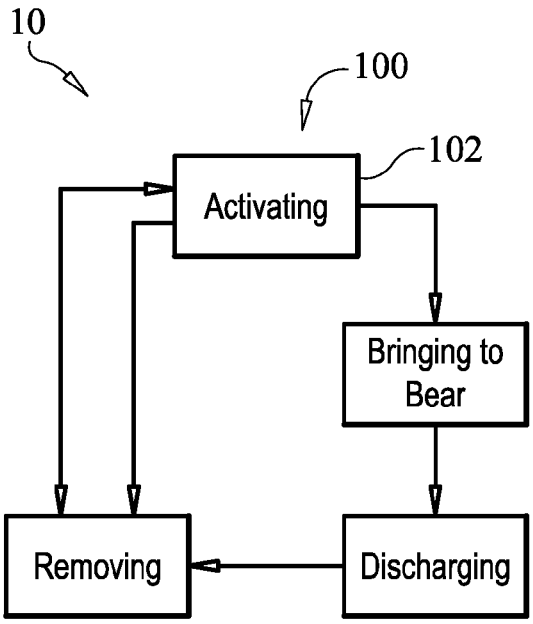
FIG. 3 is substantially flowchart for one possible embodiment for a method of using the stun glove.
Figure 4:
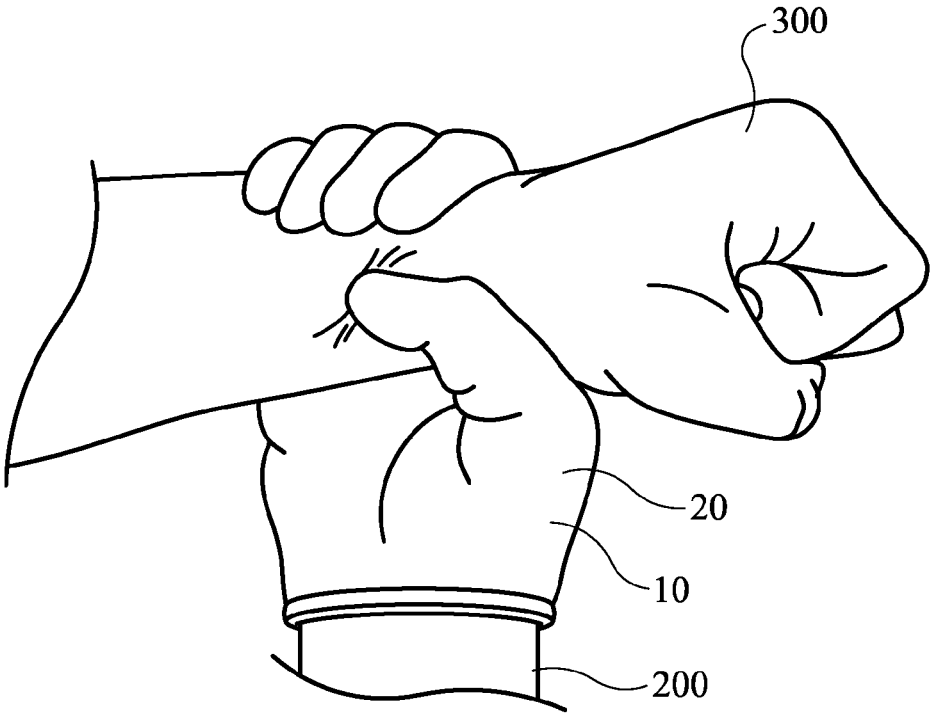
FIG. 4 is substantially a perspective view of the operator grasping an arm of the assailant with the invention and placing a thumb portion of the invention into an assailant to create an electrical discharge charge.

As substantially shown in FIGS. 3 and 4, one possible method or process 100 of operating the invention 10 could start with step 102, putting on and activating the stun glove. In this step, the invention 10 could come as a pair of gloves, with at least one of the gloves could be the stun glove 20 and the other an ordinary or dummy glove, although the invention 10 could operate as a pair of fully operative stun gloves. The operator 200 could then fit the stun glove 20 to the operator's hand to generally ensure the hand is snugly and surely received within the cavity and that the fingers and thumb(s) are appropriately received within the finger and thumb sleeves. It is generally understood that the operator's thumb should be so situated within the thumb sleeve to allow the operator 200 to feel through the thumb sleeve the position of the trigger mechanism to allow the operator 200 to press the trigger mechanism into an object (e.g., physically contacting an assailant) to discharge the invention 10. Once the stun glove 20 is comfortably secured upon the appropriate hand, the operator 200 with the other hand can reach over and move that flap to access the energizing switch to energize the electronic circuitry (e.g., slide the switch to the "on" position.) The energized electronic circuitry could power the LED to confirm to the operator 200 that the electronic circuitry is energized and that the stun glove 20 is "armed". It should be further noted that the operator 200 could wear a pair of stun gloves 20 for maximum defensive capability. When this step is substantially completed the process 100 could proceed to step 104, bring the invention to bear or to step 106, removing the glove.

In step 104, bringing the invention to hear, the operator 200 could notice the commencement of an event warranting self-defense. Such an event could be unwarranted intrusion in proximate to personal space or direct violation of personal space of the operator by one or more third parties (e.g. assailant 300), issuance of verbal clues by said third parties ("give me your wallet"); direct, unwarranted physical contact by said third parties; or the like. If the attack is from the front, the operator 200 could raise its arms in a blocking motion, putting the stun glove 200 in between it and the assailant(s) 300, with the palm open and forward towards the assailant 300 so as to bring the finger tips and leading edged of the thumb into contact with the assailant (e.g., grabbing the assailant 300 by the arm, throat/neck, face, genitals, leg, chest, etc with the stun glove.) If the attack is from behind, the operator 200 could reach for the assailant's arms as they are grabbing her or rearward reach for the assailant's torso or downward for the assailant's leg.

As noted above, the positioning and construction of the trigger mechanism/front edge of the thumb sleeve may generally require the operator 200 to place the stun glove's thumb tip into the body of the assailant 300 ("dig into") with a modicum of force to close the trigger mechanism/circuit to cause the electrical discharge by the stun glove 20. The positioning and force requirements of the invention 10 should be balanced between the need for effective, capable discharge and the need for the prevention of accidental discharge. Once this step is substantially completed, the process 100 could proceed to step 106, discharging the invention.

In step 106, discharging the invention, the operator 200 could press the leading edge of the thumb tip of the glove portion into the assailant 300 or any other object that could provide some support to allow the trigger mechanism to be activated by the operator pressing against it while allowing the electrodes to maintain contact with the assailant. Once activated, the trigger mechanism completes the electrical circuit for electrical charge creation and issues the electrical discharge. It should be noted that when the electrodes transmit the electrical charge, there generally is no accompanying buzzing/snapping sound as when occurs with a non-body contact discharge of the invention. A smaller buzzing sound may be noticed in body contact discharge.

The effectiveness of the discharge could be observed in the physical reaction of the assailant. Based upon this physical reaction, steps 104 and 106 could be repeated upon the assailant 300 as necessary to incapacitate the assailant 300. Once the assailant incapacitation has occurred, the operator 200 could leave the scene for additional safety; notify law enforcement; or do both or other actions. Once this step is substantially completed, the process 100 could proceed to step 108, removing the invention.

In step 108, removing the invention, the operator 200 could with his free hand move the flap covering energizing switch and LED and deactivate the energizing switch (e.g., slide/move it to the "off" position.) After the LED is no longer illuminated (signifying the stun glove/electronic circuit is de-energized) the operator could remove its hand from the stun glove. As needed, the process could return to step 102 for further use.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As seen in the above-description and accompanying drawings, the present invention is a stun glove whose placement of the electrodes proximate to the finger tips of the glove and placement of the trigger mechanism in the leading edge of the thumb tip makes it easier to grab an assailant and discharge the electrical incapacitating charge into the assailant. The same structure may also reduce the accidental discharge of the invention upon the operator through inadvertent contact of the trigger mechanism upon the person of the operator. The composition of the stun glove also may disguise its offensive self-defense capacity to give a tactical edge to the operator in an assault situation.

What is claimed is:

1. A stun glove comprising:

(A) a glove portion made from a laminate of an inside material and an outside material, the laminate forms a cavity adapted for covering at least a portion of a hand within at least a thumb sleeve;

(B) an electronic circuitry when activated by a trigger mechanism generates a pulsed electrical charge to a plurality of electrodes, the electronic circuitry being embedded within the laminate in a manner to expose each said electrode to a glove portion exterior; and (C) the trigger mechanism in a leading edge of a tip of the thumb sleeve, a plastic strip being located within the laminate in a manner that both places the plastic strip between the trigger mechanism and a thumb inserted into thumb sleeve and further imparts an extra rigidity to the laminate;

wherein the leading edge location of the trigger mechanism requires the operator to use the thumb to press the plastic strip towards the trigger mechanism to direct the leading edge into a surface to subsequently activate the trigger mechanism to cause an electrical discharge through the plurality of electrodes.

2. The stun glove of claim 1 further comprising at least a first finger sleeve and a second finger sleeve formed by the glove portion, each sleeve capable of receiving a respective finger of the hand.

3. The stun glove of claim 2 wherein one electrode of the plurality of electrodes is located upon an underside of respective finger sleeve proximate to a tip of the finger sleeve.

4. The stun glove of claim 2 wherein the glove portion further forms additional finger sleeves, each additional finger sleeve covers a respective remaining finger of the hand.

5. The stun glove of claim 4 wherein each of the additional finger sleeves further mounts a respective electrode from the plurality of electrodes.

6. The stun glove of claim 1 wherein an energizing switch, circuitry board, and power supply of the electronic circuitry are located within the laminate on a back side of the glove portion.

7. The stun glove of claim 6 wherein the electronic circuitry further comprises an illumination source to indicate whether or not the electronic circuitry is energized.

8. The stun glove of claim 7 further comprises a flap that reversibly covers the illumination source and the energizing switch.

9. The stun glove of claim 7 wherein the laminate further comprises an insulating material to prevent a bleed back into the hand of an electrical charge discharged from the electrodes.

10. A method for operating a stun glove comprising the following steps, but not necessarily in the order shown:

(A) providing a stun glove having a glove portion that is formed of a laminate that reversibly receives and encapsulates at least a portion of a hand and the laminate further mounts electronic circuitry for generating a pulsed electrical charge that is discharged through electrodes in finger sleeves formed by the glove portion when a trigger mechanism located in a leading edge of a tip of a thumb sleeve as formed by the glove portion is activated, the thumb sleeve further comprises of a plastic strip located within the laminate in a manner that imparts an extra rigidity to the laminate and further places the plastic strip between the trigger mechanism and a thumb inserted into the thumb sleeve;

(B) energizing the electronic circuitry to generate a pulsed electrical charge;

(C) pressing the thumb as inserted in the thumb sleeve against the plastic strip to move the trigger mechanism together with the leading edge against a surface to activate the trigger mechanism; and (D) discharging the pulsed electrical charge through the electrodes.

11. The method of claim 10 wherein the surface does not pertain to a body of an assailant or operator.

12. The method of claim 10 further comprising a step of preventing a bleeding of an electrical charge back into the hand by an insulating material contained within the laminate surrounding the electrodes.

13. The method of claim 10 further comprises a step of uncovering a flap to determine whether or not the electronic circuitry is energized.

14. The method of claim 13 wherein the step of uncovering the flap further comprises a step of observing an illumination source.

15. The method of claim 10 wherein pressing the thumb further comprises the step of digging in the leading edge of the tip of the thumb sleeve into the surface.

* * * * *